United States Patent [19]

Fremgen et al.

[11] Patent Number: 5,071,365

[45] Date of Patent: Dec. 10, 1991

[54] CABLE CONDUCTOR CLAMPING CONNECTOR

[75] Inventors: Dieter Fremgen, Wulfrath; Horst Hoffmann, Lundenscheid; Alban Vernaleken, Detmold, all of Fed. Rep. of Germany

[73] Assignee: Raychem Corporation, Menlo Park, Calif.

[21] Appl. No.: 671,584

[22] Filed: Mar. 19, 1991

[51] Int. Cl.[5] ..... H01R 4/24

[52] U.S. Cl. ..... 439/402

[58] Field of Search ..... 439/389–425

[56] References Cited

U.S. PATENT DOCUMENTS

| | | | |
|---|---|---|---|
| 3,012,219 | 12/1961 | Levin et al. | 439/402 |
| 3,118,715 | 1/1964 | Potruch | 439/402 |
| 3,233,206 | 2/1966 | Fiala | 439/402 |
| 3,890,029 | 6/1975 | Izraeli | 439/402 |

*Primary Examiner*—Joseph H. McGlynn

*Attorney, Agent, or Firm*—Herbert G. Burkard; William D. Zahrt, II; A. Stephen Zavell

[57] ABSTRACT

A cable connector clamping connector comprises a plastics housing consisting of at least two elements having integrated therein a contact blade for contacting the ends of cable conductors which have been pushed into the housing. After inserting the cable conductors, the housing halves can be pushed together to lock, applying to the cable conductors the force necessary to press them into the contact blades for contacting. In order to make it possible for the user to check the depth of insertion in order to be certain that contacting is guaranteed in every case and with which, at the same time, a catch effect with respect to the outlet direction of the conductors is achieved, a resistance element, in the form of a plastics tongue, for tangibly signalling the depth of insertion of the cable conductor into the housing is provided in the effective insertion channel of each cable conductor, behind the contact blade in the direction of insertion.

8 Claims, 2 Drawing Sheets

CABLE CONDUCTOR CLAMPING CONNECTOR

BACKGROUND OF THE INVENTION

1. Field of the Invention

This invention relates to a cable conductor clamping connector. In particular it relates to such a connector comprising a plastics housing consisting of at least two elements and having integrated therein a contact blade for contacting the ends of cable conductors which have been pushed into the housing, wherein, after inserting the cable conductors, the housing halves can be pushed together to lock, applying to the cable conductors the force necessary to press them into the contact blades for contacting.

2. Introduction of the Invention

Many constructions of cable conductor contact elements of the kind described here are known, for example from U.S. Pat. No. 3,573,713 or DE 23 10 646-A1. The latter describe plastics housings consisting of a lower dish part for the insertion of double paired cable conductors with a lid element having contacting cutting elements which can be pressed into the lower dish part from above. A similar construction for single cable conductors is disclosed in EP-0 062 963-B1 or EP-0 347 100-A2. The latter also discloses the possibility of constructing the clamping/cutting element in a U-shape as a one-piece, double action metal part. A slightly different solution precisely with regard to the construction of the clamping/cutting elements is disclosed in DE 28 40 308 or, in the case of a multiple conductor connector, in DE-23 38 056-B2.

A feature common to all the known solutions is that, when pushing in the cable conductors, the user has to hope that they have been pushed sufficiently far into the housing of the devices for an electrical contact to be reliably made via the clamping/cutting elements upon pressing the elements of the housing together. Direct checking of the depth of insertion is not possible or is possible only with difficulty. If the lid has been pushed slightly into the other element through carelessness or at the factory, there is the danger that when the cable conductors are pushed in they will strike against the first clamping/cutting blade yet the user will believe that they have been pushed completely into the device. When the clamp is then pressed together, electrical contacting is not achieved.

An object of the invention is to provide a solution which makes it possible for the user to check the depth of insertion in order to be certain that contacting is guaranteed in every case, and also, at the same time, to achieve a catch effect with respect to the outlet direction of the conductors.

SUMMARY OF THE INVENTION

The present invention provides a cable conductor clamping connector comprising a plastic housing having effective insertion channels into which cable conductors to be connected can be inserted, the housing:

a) having integrated therein a contact blade, b) comprising at least two elements which can be pushed together, in use, so as (i) to lock the two elements together and (ii) to apply a force onto the cable conductors sufficient to press them into electrical contact with the contact blades, and c) comprising at least one resistance element which (i) is in the form of a plastics tongue for signalling the depth of insertion, in use, of the cable conductors into the housing and (ii) is provided in the effective insertion channel behind the contact blade in the direction of insertion

BRIEF DESCRIPTION OF THE DRAWINGS

The invention is described in detail below, by way of example, with reference to the drawings, in which FIG. 5 shows a view in section of a further embodiment in the insertion position of a cable conductor.

DETAILED DESCRIPTION OF THE INVENTION

Figure 1:
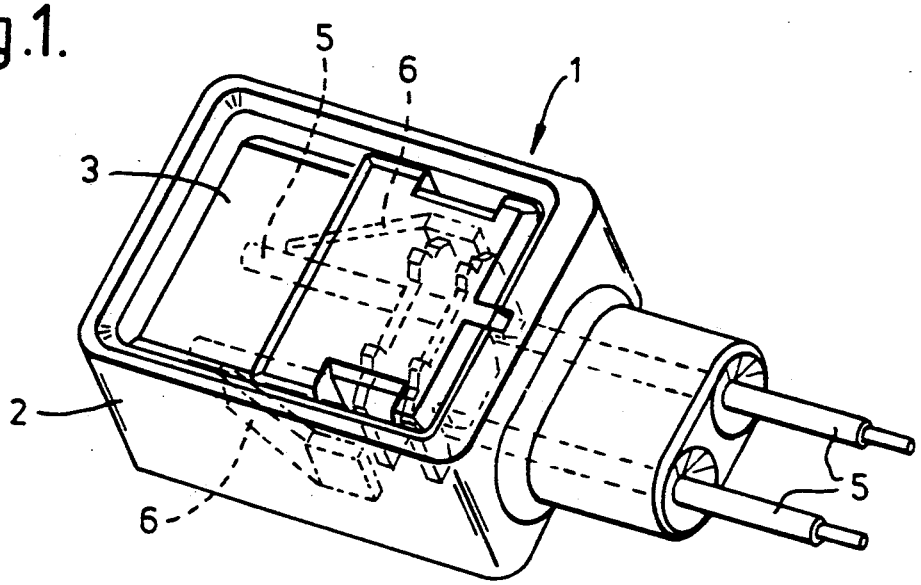
FIG. 1 shows a plan view in perspective of a cable conductor clamping connector according to the invention.

As a result of the invention, the user is able to tell how far he has pushed in the cable conductor. As soon as the resistance element, which at the same time acts as a retaining catch, offers a resistance during insertion, the user knows that he has already guided the conductor past the clamping/cutting element so that, on pressing the elements of the device together, contacting will always be achieved. A plastics tongue makes it especially easy to produce precisely the function of a retaining catch since it can be constructed to be, for example, sharp-edged at its free end. If a cable conductor that has been guided past the free end of the tongue is then pulled out, the sharp free edge of the plastics tongue grips into the outer insulation of the conductor and holds it back.

In construction, the plastics resistance elements may be provided arranged on one of the housing elements via a film hinge so as to be pivotable into the operational position in the position of use, from a different position, in which they were provided during manufacture. This construction makes it possible to manufacture the individual elements comparatively easily.

In one embodiment the resistance elements may be constructed as plastics tongues (6*a*) that are integrally formed on the underside (10) of the upper part (3*a*) of the connector.

According to the invention, there may also be provided, in addition to the contact blade, a further clamping and/or cutting blade arranged in front of the resistance element.

As already mentioned at the beginning with regard to the prior art, it is known to provide tandem cutting blades. These are formed, however, from a single sheet of metal. The present invention departs from this in that it provides two clamping/cutting blades constructed separately from each other. In this case also, the resistance element which acts as a retaining catch is preferably arranged behind the two clamping/cutting blades viewed in the direction of insertion, so that its function of enabling the user to feel when the cable conductors have been inserted sufficiently far into the connector is fully retained in this case also.

In this connection, the invention can make provision for the further clamping/cutting blade to be arrange first in the direction of insertion in the cable channel and to be constructed as an additional strain relief element. It is also possible for this further clamping/cutting element to be manufactured from a material which is inferior to that of the contacting cutting element, in terms of electrical conductivity.

This selection of different materials is not possible, for example, in one-piece tandem cutting blades which may be formed only of one material, which entails the disadvantage, especially in the case of optimum electrical conductivity, that the entire element has to consist of the expensive material. The present invention makes it possible to avoid that disadvantage.

According to the invention, provision is also made for regions of the resistance element to be constructed as locking elements for locking the two housing parts of the device together after the resistance element has been pivoted into the operational position.

Figure 3:
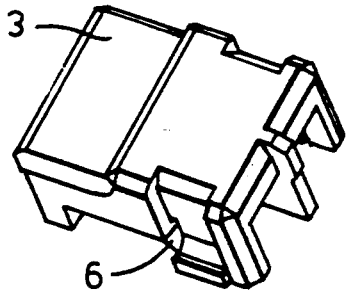
FIG. 3 shows a plan view of the upper part of the connector in perspective.
Figure 4:
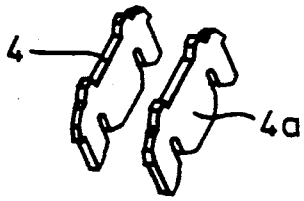
FIG. 4 shows clamping/cutting blades shown separately.
Figure 5:
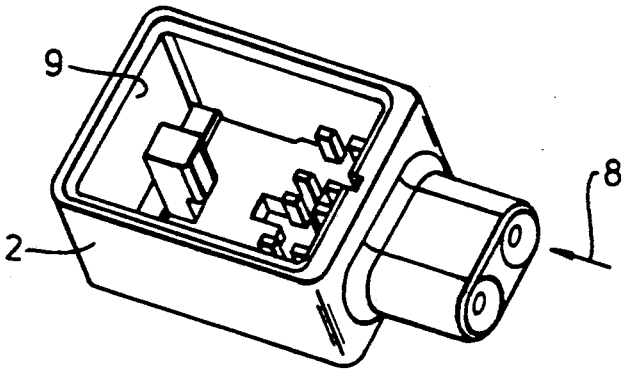
FIG. 5 shows a plan view in perspective of the lower part of the clamping connector.

Referring now to the drawings, the cable conductor clamping connector generally designated 1 is formed substantially by two-part plastics housing, namely the lower part 2 of the connector shown in perspective in FIG. 5 and the upper part 3 of the connector, shown three-dimensionally in FIG. 3, which can be pushed into that lower part 2 from above.

Two metallic clamping/cutting blades 4 and 4*a* are inserted into the upper part 3 of the connector at the factory, it being possible for the clamping/cutting blade 4*a* that is first when viewed in the direction of insertion of the cable conductors, designated 5 in FIG. 1, to be made from a metal that is inferior in terms of electrical conductivity, but has a high loading capacity, whereas the second clamping/cutting blade 4, arranged behind it in the direction of insertion, may be made from a material of optimum electrical conductivity.

Important features of the invention are the resistance elements which act as retaining catches and which are integrally injection-moulded on the upper part 3 of the connector and shaped as plastics tongues. In the Figures, they bear the reference numeral 6. The free forward edge can be constructed as a sharp-edged clamping edge 7 and come to rest on the outside of the inserted cable conductors, as is shown by broken lines in FIG. 1. The clamping/cutting blades 4 are inserted in the upper part 3 at the factory, as is also apparent from FIG. 2.

Figure 2:
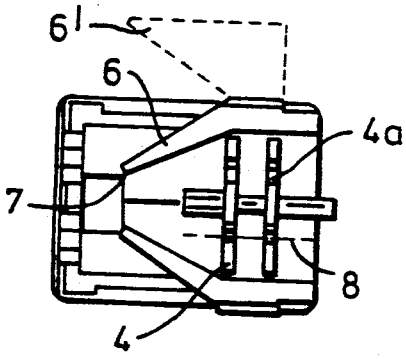
FIG. 2 shows a view from below onto the upper part which is to be connected.

The mode of action of the cable conductor clamping connector 1 is as follows:

The upper part 3 is pushed slightly into the lower part 2 in such a manner that the clamping/cutting blades 4 and 4*a* lie above the effective insertion channel for the cables, (the channels are designated 8 in FIG. 2). The geometrical arrangement of the resistance elements 6 is such that at least the forward edges 7 project into the insertion channels 8. If a cable conductor 5 is then pushed in, the user feels the resistance of the tongues 6 as soon as the cable conductors strike against them. He then needs merely to push the cable conductors lightly further forward until they strike against the end wall 9 of the lower housing element 2. When both cable conductors 5 have been pushed in, the upper part 3 is pressed fully into the lower part 2 and locked with it. Therewith, the clamping cutting elements come in contact with the cable conductors, the forward clamping/cutting element 4*a* provides strain relief and the rearward element 4 the electrical contact.

The shape of the resistance elements 6 can be such that, at the same, they have certain locking undercuts, the corresponding recesses in the lower part 2 serving to lock the two elements 2 and 3 together, which is not shown in detail here.

The upper part 3 can be manufactured, for example, in such a manner that the resistance elements 6 are folded horizontally outwardly in the plastics injection mould and can only be pivoted into an operational position such as that shown in the drawings, the as manufactured position being indicated by broken lines in FIG. 2.

Figure 6:
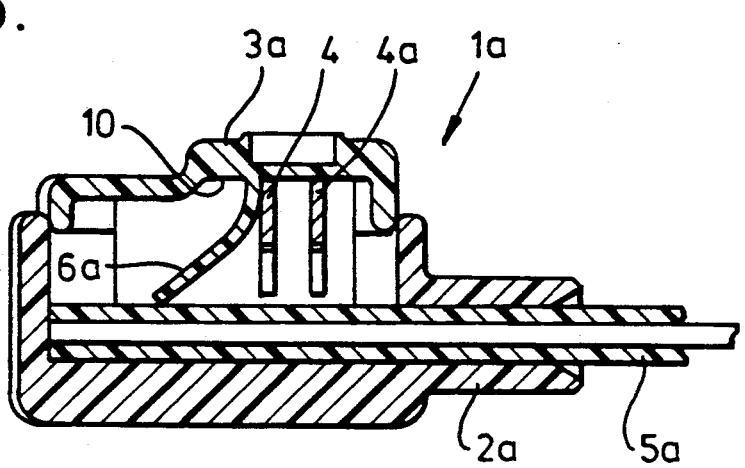
Figure 7:
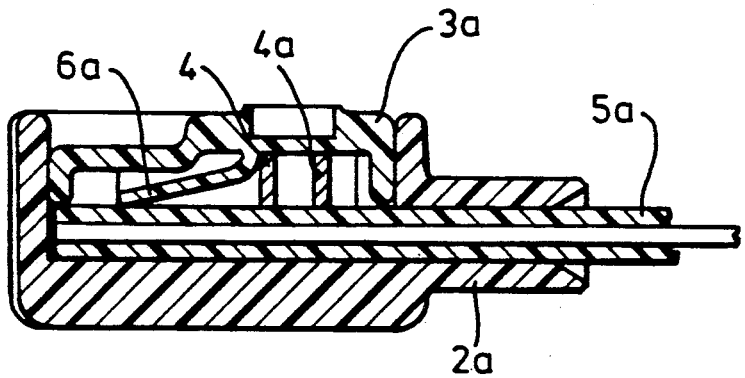
FIG. 7 shows, in the same manner, the locked position.

FIGS. 6 and 7 show a modified embodiment of a cable conductor clamping connector generally designated 1*a* therein, all reference numerals that refer to the same parts as those in the embodiment shown in FIG. 1 being the same but supplemented by the letter "a".

In this case, the upper part 3*a* of the connector, which is opposite the lower part 2*a* of the connector, has integrally injection-moulded plastics tongues 6*a* on its inner face, designated 10, which plastics tongues are pivoted into the insertion channel of the cable conductor 5*a*.

If a cable conductor 5*a* is inserted from the right, the user will feel the resistance of the free end of the plastics tongue 6*a*. The contact situation after the upper part 3*a* of the connector has been pressed in and locked is in this case shown again in FIG. 7.

We claim:

1. A cable conductor clamping connector comprising a plastic housing having effective insertion channels into which cable conductors to be connected can be inserted, the housing:

a) having integrated therein a contact blade, b) comprising at least two elements which can be pushed together, in use, so as (i) to lock the two elements together and (ii) to apply a force onto the cable conductors sufficient to press them into electrical contact with the contact blade, and c) comprising at least one resistance element which (i) is in the form of a plastics tongue for signalling the depth of insertion, in use, of the cable conductors into the housing and (ii) is provided in the effective insertion channels behind the contact blade in the direction of insertion.

2. A cable conductor clamping connector according to claim 1 wherein the resistance elements are constructed as plastics tongues that are integrally formed on one side of one of the elements of the connector.

3. A cable conductor clamping connector according to claim 1, wherein regions of the resistance element are constructed as locking elements for locking the two elements of the housing together.

4. A cable conductor clamping connector according to claim 1, where the plastics resistance elements are arranged on one of the housing elements via a film hinge in a pivotal manner so they can be pivoted from a position in which they are provided during manufacture into an operational position in the position of use.

5. A cable conductor clamping connector according to claim 4, wherein regions of the resistance element are constructed as locking elements for locking the two elements of the housing together after the resistance element has been pivoted into the operational position.

6. A cable conductor clamping connector according to claim 1, wherein there is provided, in addition to the contact blade, a further clamping and/or cutting blade which is arranged in front of the resistance element.

7. A cable conductor clamping connector according to claim 6, wherein the further clamping/cutting blade is arranged first in the direction of insertion in the cable channel and is constructed as a strain relief element.

8. A cable conductor clamping connector according to claim 6 wherein the further clamping/cutting element is formed from a material inferior to that of the contact cutting element in terms of electrical conductivity.

* * * * *